United States Patent [19]

Wuenn

[11] 3,965,315

[45] June 22, 1976

[54] UNIVERSALLY MOUNTED, PIVOTED KEY ACTUCTOR AND ASSOCIATED SWITCH ASSEMBLY

[76] Inventor: Guenter J. Wuenn, 61 N. Arlington Ave., East Orange, N.J. 07017

[22] Filed: Jan. 8, 1975

[21] Appl. No.: 539,429

[52] U.S. Cl. ..... 200/6 A; 200/330; 74/471 XY

[51] Int. Cl.[2] ..... H01H 3/20; H01H 25/00

[58] Field of Search ..... 200/1 R, 1 A, 5 R, 6 R, 200/6 A, 6 B–6 BB, 17 R, 18, 153 K, 153 LA, 157, 159 R, 329–332, 337, 339, 340; 74/471 R, 471 XY, 491, 503; 179/90 R, 90 K; 235/145; 197/98, 100; 340/365 R, 365 L, 365 A, 365 S

[56] References Cited

UNITED STATES PATENTS

| | | | |
|---|---|---|---|
| 1,830,298 | 11/1931 | Tartaglia | 200/6 A X |
| 3,005,055 | 10/1961 | Mattke | 200/6 A X |
| 3,040,827 | 6/1962 | Ulinski | 200/6 A X |
| 3,277,248 | 10/1966 | Melvin, Jr. | 200/6 A |
| 3,439,568 | 4/1969 | Griffith | 200/157 X |
| 3,519,775 | 7/1970 | Weremey | 200/6 BB X |

*Primary Examiner*—James R. Scott
*Attorney, Agent, or Firm*—McGlew and Tuttle

[57] ABSTRACT

A switch construction, particularly a rapid data entry switch for connecting one or more select contact circuits comprises a first block member which has a first finger engagement side and an opposite second side which is arranged in opposition to a second block member first side. The second block member defines one or a plurality of contact guide bores therethrough and it provides a pivotal support base for the first block member. The first block member advantageously has recesses defining finger engagement positions which when depressed by a finger engagement will cause the first block member to pivot on the second block member to displace a select contact rod member in order to cause it to actuate or establish a connection in a select contact circuit. The block member is comprised of rectangular block elements having opposed surfaces which are formed as pyramidal segments which interengage.

10 Claims, 11 Drawing Figures

UNIVERSALLY MOUNTED, PIVOTED KEY ACTUCTOR AND ASSOCIATED SWITCH ASSEMBLY

BACKGROUND OF THE INVENTION

This invention relates in general to switch construction and in particular to a new and useful switch which is adapted to be used as a rapid data entry switch and which includes first and second block members which are pivotally interconnected so that one is universally movable in respect to the other and may be pivoted in a direction to move one or more contact members which are guided in the bores of the other in a direction to effect an electrical contact.

DESCRIPTION OF THE PRIOR ART

A very large number of electrical switches are known including those which comprise an actuating knob or button which is depressable to cause contact engagement between an intermediate contact member and one or more of a plurality of opposite contact posts. The known switch constructions permit selective contact of a single post in accordance with the direction of pivotal movement of an actuating know member. The disadvantage in the known constructions is that they are not always sufficiently accurate to permit a selection of a single contact connection without also effecting other contact connections. And, in addition, the mechanical mountings of such switches tend to wear out or become misaligned after short periods of use. The further disadvantage in the known constructions is that the pivotal member, which is movable to effect the contact, is not constructed so that it is sufficiently easy to indicate which of the selected contact elements will be interengaged. In addition, the guidance of the members so that they will move all in the selected direction is not adequate to effect a proper switching.

SUMMARY OF THE INVENTION

In accordance with the present invention a switch is provided which includes two mutually interengageable and cooperative block members. A first one of the block members is pivotally mounted on the second for universal pivotal movement and the opposed surfaces of the block members are formed as cams which provide guidance elements to permit select controlled movement of the first block member during its pivotal movement. This controlled movement is effective to displace one or more of a plurality of contact rod members which are guided for longitudinal movement in bores which extend from the opposed guide cam surface of the second block member to the opposite side thereof. In the preferred form the first block member is provided with a top face with recesses and indications for finger engagement at a spaced location from the pivotal center so that the first block member may be pivoted and moved in a select direction to actuate a selected one of the contact rod members and displace it into a contact engagement position. Thus with the invention both the contact rod actuated members and the first block member which controls the operation thereof may be guided accurately in accordance with which one of the pivotal motions of the first block members to be effected and in accordance with which of the contact rod members is to be moved to an actuated position.

With the inventive arrangement the first block member may be constructed so that it may move toward the contact rod element in a single downward movement centered over the pivotal location or it may be pivoted off center to the pivotal location to effect a controlled actuation of a single one of the contact rod elements.

Each of the block members advantageously includes opposed cooperative contact surfaces which are pyramidal in form and are cut into one of each of four block side faces of the associated block members. Such a construction permits four or more separate control pivotal movements of the first block member to effect a select displacement of a contact rod member or a combined movement of all of the rod members. The geometry of this construction is such that the blocks may be made of any number of sides and the pyramidal formations may be cut into each side in order to effect a very large number of selected pivotal acturation movements. A switch of this nature may be used with digital, analog, direct current, tone generator, etc. type signals for a wide variety of applications. Keyboards which are used on desktop calculators or computers may advantageously employ a switch of this nature and one or more of the switch elements may be employed to replace all of the usual key button actuators which are employed in the known types of calculators.

Accordingly it is an object of the invention to provide an improved switch construction which comprises first and second members which are mounted for universal pivotal movement in respect to each other with one of them forming a guide for one or more contact rod elements and the other forming a movement member which is pivotally mounted on the first which may be pivoted about one or more select pivotal axis directions for the purpose of effecting a controlled movement of the contact rod elements.

A further object of the invention is to provide a contact switch which includes a finger actuatable member which is mounted so that it may be moved through one or a plurality of individual contact movement directions by finger engagement therewith and wherein the contact member is provided with finger engageable recesses for facilitating the operation thereof in a correct manner by selective finger engagement.

A further object of the invention is to provide a switch which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
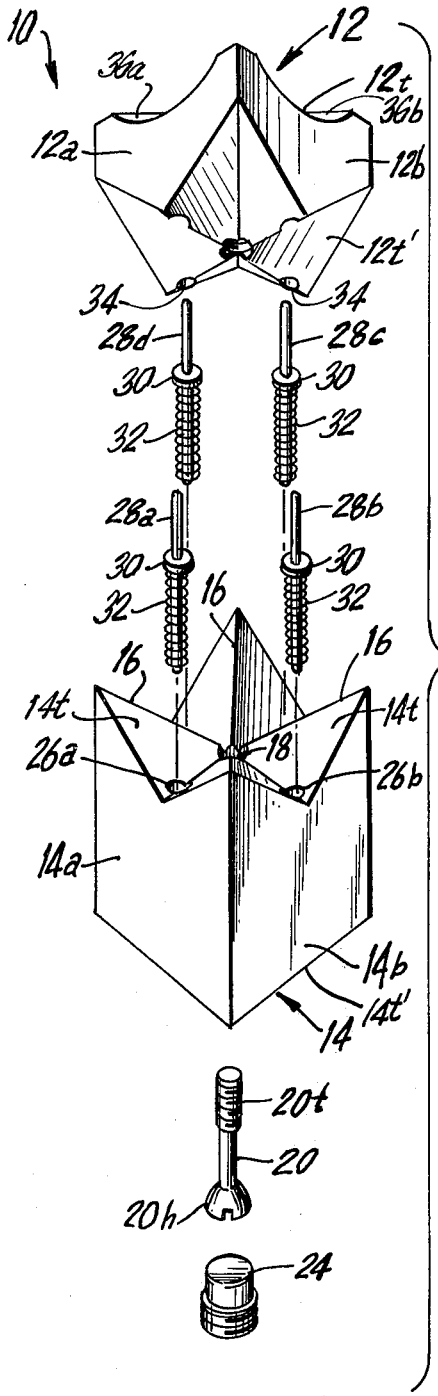
FIG. 1 is an exploded perspective view of a switch constructed in accordance with the invention.

Referring to the drawings in particular the invention embodied therein comprises a switch construction generally designated 10 which, for example, may be rapid data entry key switch, a general circuit control switch, etc..

In accordance with the invention the switch 10 includes a first block member or finger contact member generally designated 12 which is universally pivotally mounted in respect to a second block member or contact guiding member generally designated 14. In the embodiment shown either of the block members 12 and 14 are of generally rectangular block shaped configuration and they each include four separate sides, 12*a*, 12*b*, 12*c*, 12*d* and 14*a*, 14*b*, 14*c* and 14*d*. The first block member 12 includes a first side or top 12*t* and a second side or bottom 12*b*. The second side or bottom 12*b* of the first block member 12 is arranged in juxtaposition with a first side or top 14*t* of the second block member 14. The second block member 14 has an opposite second side or bottom 14*b*.

In the embodiment of the invention shown the second block member 14 has triangular recesses in the top surface of each side face and each corner slopes downwardly and inwardly along slope line 16 to a central pivot bore 18.

Figure 4:
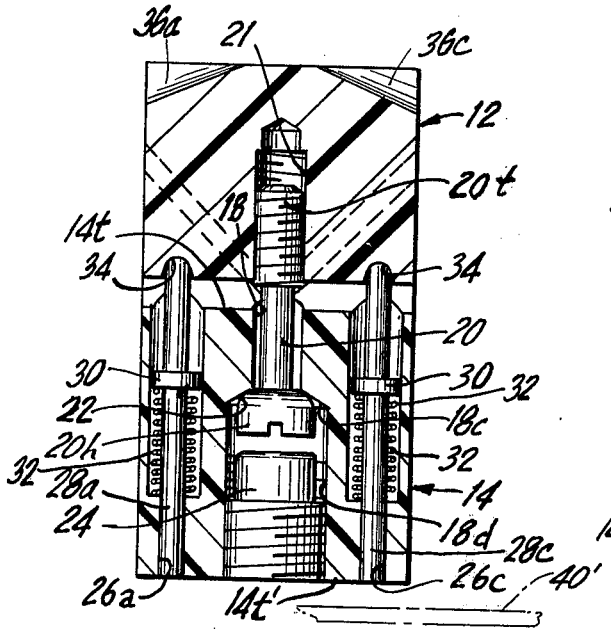
FIG. 4 is a section taken along the line 4—4 of FIG. 2.

As best seen in FIG. 4, the pivot bore 18 extends downwardly from the top surface 14*t* to a frusto conical bore portion 18*c* and a widened diameter lower bore portion 18*d*. Pivot bolt 20 is loosely inserted in the bore 18 and it has a head portion 20*h* which has a rounded universal pivot surface 22 which pivots on the frusto conical bore portion 18*c*. The opposite end of the pivot bolt 20 is provided with a threaded portion 20*t* which is threaded into the first block member 12. The first block member 12 is therefore centrally pivotally mounted on the second block member 14 on universal pivot means which include the bolt 20 and the pivotal surface 22. A plug 24 is inserted into widened diameter bore portion 18*d*.

The second block member or contact guide member has a plurality of bores which in the embodiment shown comprises four separate bores 26*a*, 26*b*, 26*d* and 26*e* which are arranged at fixed radii and fixed equidistances around the pivot bore 18. Each guide bore 26*a*, 26*b*, 26*c* and 26*d* and provides a guideway for a contact rod or rod element 28*a*, 28*b*, 28*c*, 28*d*. The contact rods 28*d* are of a length such that the ends thereof do not extend outwardly from the bottom 14*b*. Each guide element carries a collar 30 which is biased by a coil spring 32 upwardly so as to cause the upper end of each guide element to engage in receiving recesses 34 of the first block member 12. The pivot bolt 20 may be threaded into the receiving bore 21 of the first block member 12 by an amount which will retain some pressure on the spring 32 and which will maintain the first block member 12 at a spaced location from the second block member 14 so that a universal pivotal movement of the first block member in respect to the second block member may take place.

Figure 2:
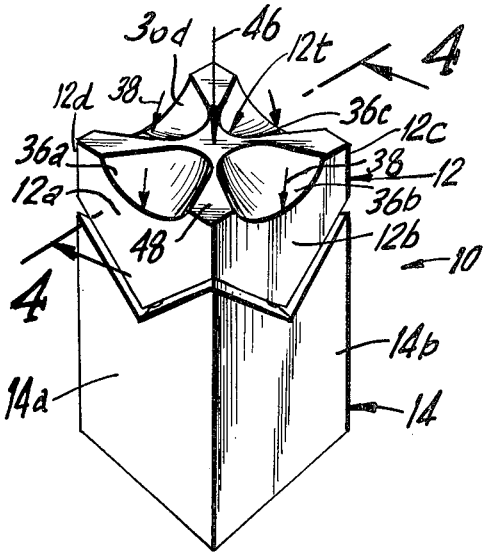
FIG. 2 is a top perspective view of the switch.
Figure 3:
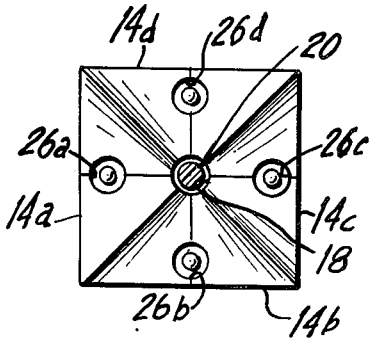
FIG. 3 is a top plan view of the second block member.
Figure 7:
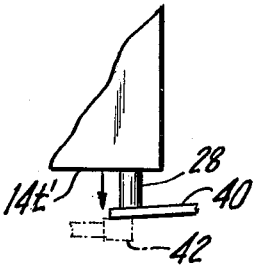
FIG. 7 is a partial side elevational view showing the contact rod elements being used as a contact.
Figure 8:
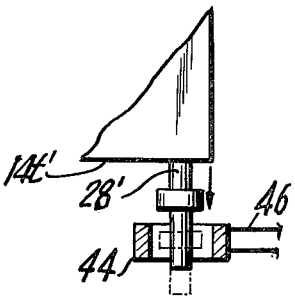
FIG. 8 is a view similar to FIG. 7 showing the contact rod member being used as a magnetic switch actuator.

In accordance with a feature of the invention the top surface 12*t* of the first block member advantageously comprises a finger contact surface to permit finger operation. In the preferred embodiment shown in FIG. 2 each side face is cut inwardly to define a finger outlined recess, 36*a*, 36*b*, 36*c* and 36*d*. The finger outlined recesses are curved so as to smoothly accommodate the tip of a person's finger. When the finger is inserted in one of the recesses, and pressure is applied in the direction of an arrow 38, the first block member 12 will pivot downwardly at the arrow selected and this is at a location which overlies a triangular cutout portion of the second block member 14 and the projecting tip of the associated contact rod 28. This will cause the contact rod 28 to be depressed or moved in a direction to establish a connection to a contact circuit or a contact switch, etc. For example, when one of the contact rods 28*a*, 28*b*, etc. is depressed it may advantageously be moved so as to project its lower end out of the bottom portion or to extend it further out of the second block member 14, as shown in FIG. 7, to cause it to engage a first contact reed or switch element 40 and move it into engagement with a similar contact or exposed circuit connection 42 to complete a selected circuit engagement. Alternatively the movement of the contact rod 28' as shown in FIG. 8 will cause its end to move through a magnet or field coil 44 to actuate an associated circuit 46 which for example is energized by such movement or which includes a circuit contact element which is closed by magnetic attraction.

The first block member 12 also includes a top central surface area which may be depressed by applying pressure in the direction of the arrow 46 to effect movement of all of the contact rod elements 28*a*, 28*b*, 28*c* and 28*d* simultaneously. Similarly the first block member 12 includes raised edge portions which may be depressed and which are located between adjacent recesses 36*a*, 36*b*, etc., and which would effect movement of two contact rod elements, for example rod elements 28*a* and 28*b*, when pressure is applied at a corner, 48 for example.

Figure 5:
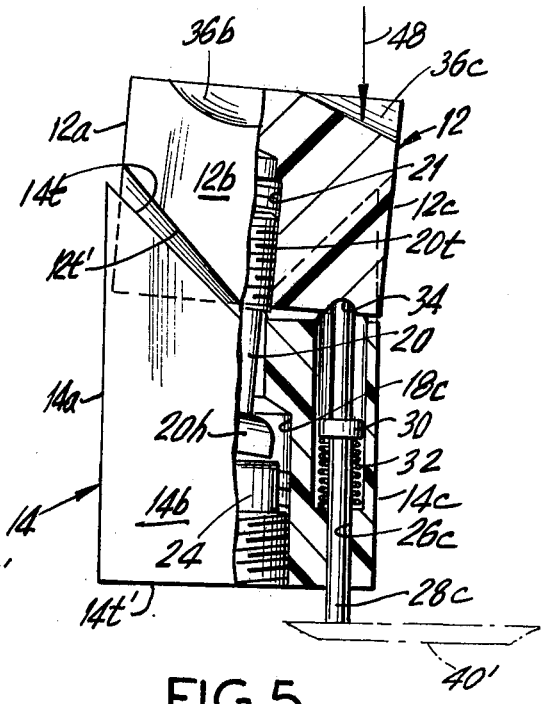
FIG. 5 is a view similar to FIG. 4 showing the switch in one actuated position.

The contact rod elements 28*a*, 28*b*, 28*c* and 28*d* may advantageously comprise either members which are conductive and which, in fact, themselves form a contact of a contact switch such as is indicated in FIGS. 4 and 5 wherein the contact member 28*c* is shown in a position in which, when actuated, it moves into electrical contacting engagement with an electrically conductive contact 40' which is connected into an electrical circuit (not shown). Naturally, the contact rod elements may be either conductive as rod elements 28*c* in FIGS. 4 and 5 or non-conductive as the rod element 28 in FIG. 7 which actuates an electrically conductive contacts 40 or they may even be magnetic or include a magnetic portion such as the contact rod member 28' in the embodiment of FIG. 8.

Figure 6:
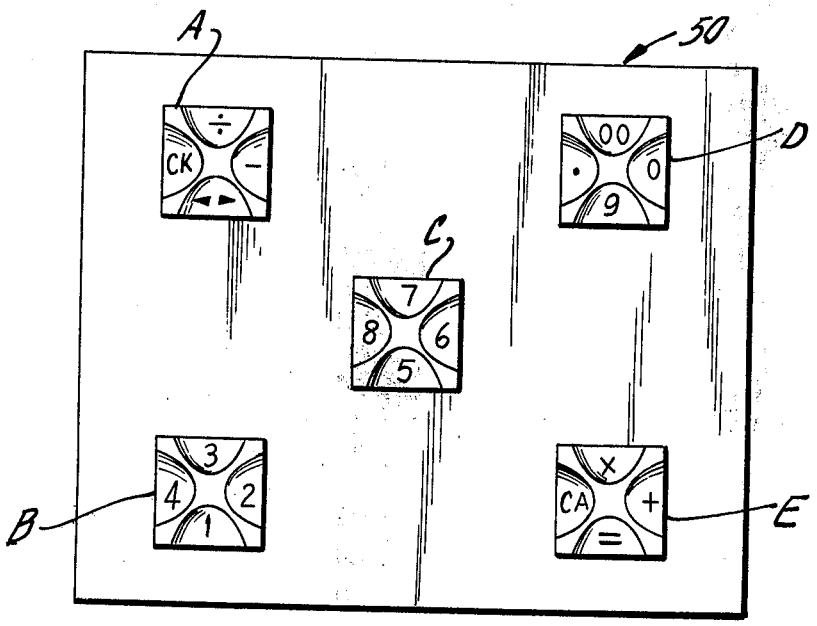
FIG. 6 is a top plan showing the use of five such switches in a calculator panel.

FIG. 6 is an example of a small pocket calculator generally designated 50. The calculator need only have five separate key elements designated A, B, C, D and E.

Figure 9:
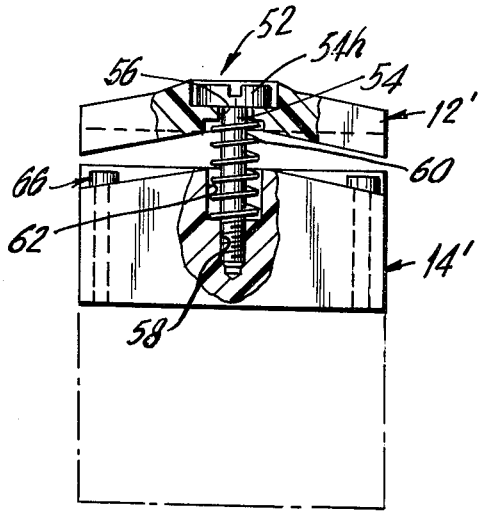
FIG. 9 is a partial side elevational and sectional view of another embodiment of switch constructed in accordance with the invention.
Figure 10:
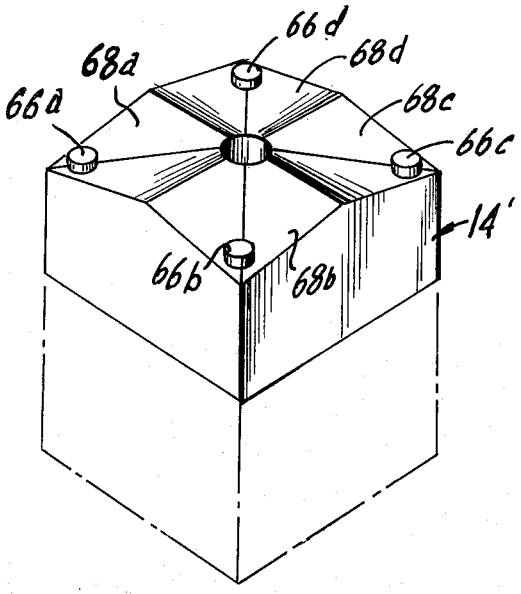
FIG. 10 is a perspective view of the embodiment shown in FIG. 9.
Figure 11:
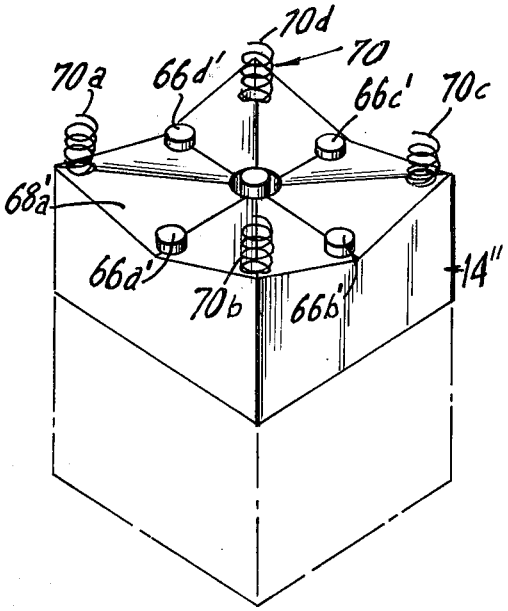
FIG. 11 is a perspective view similar to FIG. 10 of still another embodiment of the invention.

An alternate embodiment shown in FIG. 9 comprises a first block member 12' which is pivotally mounted on a second block member 14' by universal pivoting means generally designated 52 which comprises a bolt 54 extending through a bore 56 of the first block member 12' and engaged into a threaded bore 58 of the second block member 14'. The bolt 54 has a head 54h which is provided with a cross-cut for a screwdriver to tighten it in the receiving bore 58. A compression spring 60 is arranged between the first member 12' and the inner end of a recess 62 of the second block member 14'. In this construction the first block member 12' is provided with indicating recesses at each corner so that applying pressure to the first block member 12' at the associated corner will effect a controlled movement of a contact rod element 66 or the contact rod element 66 may comprise the element in the circuit which is engaged by a counter contact portion on the underside of the first block member 12'. In the embodiment of FIG. 10 each contact 66*a*, 66*b*, etc. is located at the lower end of a triangular recess 68*a*, 68*b*, 68*c*, 68*d* etc. In the embodiment of FIG. 11, however, the recesses of the triangular cutouts slope upwardly to the corners rather than to the center of each block face. In this embodiment each contact 66*a'* etc. is located in the lower end portion of a triangular recess or pyramidal recess, 68*a'*. The spring means are not directly associated with the contact rod element 66 but comprise coil springs 70 arranged at the corners of the second block member 14''. In the embodiment according to FIG. 11 no spring need be provided at the central bolt 54 but instead all of the spring action may be accommodated by the spring 70*a*, 70*b*, 70*c*, 70*d*.

The switch may also be used with solid state switch modules of a type for example which are actuated merely by motion of the contact rod elements similar to the arrangement shown in FIG. 8. The invention provides a particularly simple construction of a switch which nevertheless insures that the operating parts are properly guided and that the switch contact elements are moved precisely as desired in accordance with the portion of the switch which is actuated.

While specific embodiments of the invention have been shown and described in detail to illustrate the application of the principles of the invention, it will be understood that the invention may be embodied otherwise without departing from such principles.

What is claimed is:

1. A switch construction particularly a rapid data entry switch for connecting a selective contact circuit, comprising a first block member having a first finger contact side and an opposite second side, a second block member having a first side adjacent to said first block's second side and an opposite second side, universal pivotal support means universally pivotally supporting said first block member on said first side of said second block member, at least one contact rod receiving bore defined through said second block member extending from said first side to said second side, a contact rod movable in said bore, spring means urging said contact rod in a direction to extend out of said first side towards said first block, said first block being pivotal by contact of a protion thereof by a person's finger in a direction to engage said contact rod to displace it in said bore for establishing a connection to the contact circuit, said first and second block members having four sides and being of a rectangular block-shaped configuration, said first block second side and said second block first side having triangular form projections and recesses which are complementarily interengageable.

2. A switch construction according to claim 1, wherein there are a plurality of contact rod bores in said second block member, each having a contact rod member therein, said finger contacting surface including a plurality of defined areas overlying respective contact rod members which are selectively depressable to move respective rod members to connect a select contact circuit.

3. A switch construction according to claim 2 wherein said universal pivotal support means comprises a bolt member extending centrally of said first and second block members and having a spherical surface for effecting pivotal support of said first block member in respect to said second block member, said spring means including a spring associated with said contact rod.

4. A switch construction according to claim 1 wherein each of the four sides of said second block member has an associated triangular recess which extends downwardly from each side thereof, said at least one contact receiving bore comprising a bore in each of the recesses arranged radially outwardly from the center of the associated second block member and said first block member, said first and second block members having a through bore extending therethrough with a pivot blot in said bore comprising said universal pivotal support means, said bolt having a head of spherical configuration and the bore of said second member having a spherical recess at the end of said bore, the head of said bolt engageable on the recess for pivotal movement between said block members.

5. A switch according to claim 4 wherein said bolt is pivotally supported on a conical recess of said second block member at its one end and has an opposite end threaded into said first block member, the spacing between said block members being set by the threading of said bore in said second block member.

6. A switch construction particularly a rapid data entry switch for connecting a selective contact circuit, comprising a first block member having a first finger contact side and an opposite second side, a second block member having a first side adjacent to said first block's second side and an opposite second side, universal pivotal support means universally pivotally supporting said first block member on said first side of said second block member, at least one contact rod receiving bore defined through said second block member extending from said first side to said second side, a contact rod movable in said bore, spring means urging said contact rod in a direction to extend out of said first side towards said first block, said first block being pivotal by contact of a portion thereof by a person's finger in a direction to engage said contact rod to displace it in said bore for establishing a connection to the contact circuit, each of said first and second block members being of rectangular block-shaped configuration, each having four sides, said first block member second side and said second block member first side having complementary substantially pyramidal recesses and projections, with each side face having a top edge which slopes to an apex between corners of said second block member, said universal pivotal means comprising a pivot bolt, said first and second block members having a central bore therethrough for the passage of said pivot bolt, said pivot bolt being threaded into one of said first and second block members and being pivotal universally on the other of said block members, each of said triangular recesses and projections of said first and second block members having a contact rod connecting bore therethrough, a contact rod in each of said bores, spring means biasing said contact rod so that one end thereof projects from said second block member into contact with said first block member and the opposite end is flush with the bottom of said second block member, said contact rods being displaced by pivotal movement of said first block member to project from the exterior of said second side of said second block member.

7. A switch according to claim 6 wherein said first block member includes a finger outlined recess extending inwardly from each side wall overlying a respective contact rod receiving bore.

8. A switch construction particularly a rapid data entry switch for connecting a selective contact circuit, comprising a first block member having a first finger contact side and an opposite second side, a second block member having a first side adjacent to said first block's second side and an opposite second side, universal pivotal support means universally pivotally supporting said first block member on said first side of said second block member, at least on contact rod receiving bore defined through said second block member extending from said first side to said second side, a contact rod movable in said bore, spring means urging said contact rod in a direction to extend out of said first side towards said first block, said first block being pivotal by contact of a portion thereof by a person's finger in a direction to engage said contact rod to displace it in said bore for establishing a connection to the contact circuit, said first block member comprising a relatively flat plate block, said second block member having pyramidal recesses formed in each corner with a contact rod element projecting outwardly from the lower ends of said recesses, said first block member having pyramidal middle projections overlying the recesses of said second block member.

9. A switch according to a claim 8 wherein said universal pivotal support means comprises a bolt extending through said first block member and threaded into said second block member, said spring means comprising a spring extending around said bolt and biased between said first and second block members.

10. A switch construction according to claim 8 wherein said spring means comprises spring elements carried by said second block member and extending toward said first block member and separate from said contact rod.

* * * * *